US005273645A

United States Patent [19]

Clark et al.

[11] Patent Number: 5,273,645

[45] Date of Patent: Dec. 28, 1993

[54] MANUFACTURE OF LUBRICATING OILS

[75] Inventors: Frederick T. Clark, Wheaton; Muin S. Haddad, Naperville, both of Ill.

[73] Assignee: Amoco Corporation, Chicago, Ill.

[21] Appl. No.: 761,256

[22] Filed: Sep. 17, 1991

[51] Int. Cl.[5] ..... C10G 67/04; C10G 69/10

[52] U.S. Cl. ..... 208/87; 208/18; 208/111; 208/143; 208/58; 208/96; 208/97

[58] Field of Search ..... 208/58, 89, 59, 87

[56] References Cited

U.S. PATENT DOCUMENTS

| | | | |
|---|---|---|---|
| 4,153,540 | 5/1979 | Gorring | 208/89 |
| 4,181,598 | 1/1980 | Gillespie et al. | 208/58 |
| 4,597,854 | 7/1986 | Penick | 208/59 |
| 4,599,162 | 7/1986 | Yen | 208/59 |
| 4,636,299 | 1/1987 | Unmuth et al. | 208/89 |
| 4,648,957 | 3/1987 | Graziani et al. | 208/58 |
| 4,696,732 | 9/1987 | Angevine et al. | 208/111 |
| 4,728,415 | 3/1988 | Unmuth et al. | 208/111 |
| 4,755,279 | 7/1988 | Unmuth et al. | 208/87 |
| 4,822,476 | 4/1989 | Ziemer et al. | 208/87 |
| 4,908,120 | 3/1990 | Bowes et al. | 208/59 |
| 4,913,797 | 4/1990 | Albinson et al. | 208/111 |
| 4,921,593 | 5/1990 | Smith | 208/111 |
| 4,935,120 | 6/1990 | Lipinski et al. | 208/59 |

*Primary Examiner*—Helane Myers

*Attorney, Agent, or Firm*—Scott P. McDonald; Richard A. Kretchmer

[57] ABSTRACT

A method for reducing the pour point of a hydrocarbon feedstock that contains aromatic compounds, sulfur-containing compounds and nitrogen-containing compounds is provided. The method involves solvent extraction and utilizes a catalytic hydrodewaxing zone with a first section having a shape-selective molecular sieve-containing catalyst composition which is substantially free of Group VIII metals and a second section having a Group VIII metal-containing hydrogenation catalyst composition with a porous support material substantially free of acidic crystalline molecular sieve material.

28 Claims, 1 Drawing Sheet

MANUFACTURE OF LUBRICATING OILS

BACKGROUND OF THE INVENTION

This invention relates generally to the upgrading of hydrocarbon feed materials and, more particularly, to the processing of petroleum or other oils, such as in the manufacture of lubricating oils.

Most petroleum oils generally contain waxes which, at low temperatures, come out of solution and interfere with the flow of the oil. To produce an oil having satisfactory low temperature flow properties, such oils are typically processed to remove at least some of such wax materials. An analytical measurement for the low temperature flow property of an oils is "pour point," ASTM D-97/C-708. Oils containing relatively greater amounts of wax materials will typically have relatively higher pour point temperatures, that is, waxes will more readily form therefrom as the temperature is reduced.

The process for removing waxes, or high pour molecules, from lubricating oils (commonly referred to as "lube oils") is commonly referred to as "dewaxing." Processes for the manufacture of lubricating oils and involving dewaxing typically involve a trade-off between lube oil yield and pour point. That is higher lube oil yields can be realized at the expense of impairing product pour point and higher pour point products can be obtained at the expense of reducing lube oil yields.

In one technique of dewaxing, the oil is mixed with a solvent that is miscible with the oil but a poor solvent for the wax material. The solvent solution is than chilled, with wax material coming out of solution and subsequently being filtered from the oil.

Solvent dewaxing has been combined with various processing techniques in an attempt to produce products having desired properties. For example, U.S. Pat. Nos. 4,822,476 (Ziemer et al.) and 4,867,862 (Ziemer) disclose processes for hydrodewaxing and hydrofinishing a hydrocracked, solvent dewaxed lube oil base stock utilizing a single stage, multilayered catalyst system. In the first layer, the solvent dewaxed stock is catalytically dewaxed. In the second layer, the catalytically dewaxed material is hydrofinished. These patents report no appreciable change in viscosity, Viscosity Index (VI) or pour point relative to the use of the hydrofinishing catalyst alone.

In recent years, workers in the field have proposed various processes for the catalytic dewaxing of petroleum oils. In the preparation of lubricating oils and the like from hydrocarbon feeds, catalytic dewaxing processes have been combined with hydrotreating, hydrocracking and/or various solvent extraction steps to obtain products having desired properties. Hydrocracking and/or solvent extraction steps can be conducted prior to catalytic dewaxing to remove components such as metal-containing feed components, asphaltenes and polycyclic aromatics having properties that differ grossly from those desired. In particular, solvent extraction can be conducted to remove polycyclic aromatic feed components and nitrogen-containing cyclic components, removal of the latter typically having particular importance in order to avoid poisoning of the catalyst used for the catalytic dewaxing. Hydrotreating under mild or severe conditions can follow the catalytic dewaxing operation and can serve to improve the oxidation stability and reduce the nitrogen and sulfur content of the lube oil.

As one example of a process for producing lube oils in which a catalytic dewaxing step is included as part of a multistep process, U.S. Pat. No. 4,597,854 (Penick) discloses a process which employs alternating beds of dewaxing and hydrogenation catalysts to allegedly decrease coke deposits. In the disclosed process, the feedstock is contacted at elevated temperature with a first medium pore crystalline zeolite (such as the Group VIII metal-containing composition, Ni-ZSM-5) catalyst bed in the presence of hydrogen, subsequently contacting the partially dewaxed effluent from the first bed with at least one separate hydrogenation catalyst bed under hydrotreating conditions followed by further dewaxing the hydrotreated feedstock in at least one additional catalytic dewaxing bed and further hydrogenating the further dewaxed material in an additional hydrotreating step.

As further examples of multistep processes for preparation of lube oils, U.S. Pat. No. 4,259,170 (Graham et al.) discloses a process that includes a combination of both catalytic dewaxing and solvent dewaxing steps. According to a more specific aspect of Graham et al., the process includes a solvent extraction step prior to a dewaxing step wherein any suitable solvent, such as furfural, phenol, chlorex, nitrobenzene, or N-methylpyrrolidone is used.

U.S. Pat. No. 4,259,174 (Chen et al.) discloses a process comprising solvent extraction followed by catalytic dewaxing.

U.S. Pat. No. 4,283,272 (Garwood et al.) discloses preparation of lube oils by a process that includes hydrocracking, catalytic dewaxing and hydrotreating steps.

U.S. Pat. No. 4,292,166 (Gorring et al.) discloses a combination process wherein a dewaxing step is carried out prior to a hydrocracking step. Specifically, a hydrocarbon oil feed selected from the group consisting of vacuum gas oils, deasphalted oils and mixtures thereof is converted to a low pour point, high VI lube base stock by first dewaxing the feed in the presence of hydrogen and a dewaxing catalyst comprising a zeolite having a Constraint Index of 1 to 12, followed by contacting the dewaxed feedstock and hydrogen with a hydroconversion catalyst comprising a platinum group metal and a zeolite having a silica to alumina ratio of at least 6. Gorring et al. also contemplates interposing a conventional hydrotreating step between catalytic dewaxing and the hydrocracking step when the feed to the process contains high levels of deleterious nitrogen compounds.

A combination process is also disclosed in U.S. Pat. No. 4,358,363 (Smith) wherein a fuel oil, containing impurities deleterious to the catalyst, is first treated with a sorbent comprising a first molecular sieve zeolite having pores with an effective diameter of at least about 5 Angstroms under sorption conditions followed by a treatment with a dewaxing catalyst comprising a second molecular sieve zeolite having pores with an effective diameter of at least about 5 Angstroms and equal to or smaller than the effective diameter of the pores of the first molecular sieve zeolite. In a more specific aspect of the disclosure, the first and second molecular sieves have the same crystal structure wherein the Constraint Index is 1 to 12 and the dried hydrogen form crystal density is less than about 1.6 grams per cubic centimeter. Patentee indicates that the effectiveness of the dewaxing catalyst is increased when catalyst poisons, speculated to be basic nitrogen compounds and oxygen and sulfur compounds, are removed.

The teachings of U.S. Pat. No. 4,282,085 (O'Rear et al.) likewise appreciate the deleterious effect of nitrogen-containing impurities on ZSM-5 type crystalline aluminosilicate-containing catalysts. Specifically, patentees disclose a process for upgrading a petroleum distillate feed with a catalyst comprising ZSM-5 type zeolite possessing no hydrogenation activity wherein the feed has a content of nitrogen-containing impurities below about 5 ppm, calculated by weight as nitrogen. The low-nitrogen feedstock results in a lower deactivation rate for the catalyst.

U.S. Pat. No. 4,153,540 (Gorring et al.) discloses a process for upgrading full range shale oil. More specifically, patentees' process involves contacting the full range shale oil with a hydrotreating catalyst and hydrogen in order to convert organic compounds of sulfur, nitrogen, oxygen, and metal. The effluent from the hydrotreater is then passed to a dewaxing zone and contacted with dewaxing catalyst at conversion conditions calculated to hydrodewax the shale oil and convert at least 50% of the shale oil boiling above about 750° F. to reaction products boiling below 750° F.

U.S. Pat. No. 4,181,598 (Gillespie et al.) discloses a process for the manufacture of lube base stock oil wherein a waxy crude oil fraction is solvent refined and then catalytically dewaxed. The dewaxing catalyst is disclosed as a composite of hydrogenation metal, preferably a metal of Group VIII of the Periodic Table, associated with the acid form of an aluminosilicate zeolite having a silica/alumina ratio of at least about 12 and a constrained access to the intracrystalline free space. The effluent of catalytic dewaxing is then cascaded into a hydrotreater containing, as a catalyst, a hydrogenation component on a nonacidic support, such as cobalt-molybdate or nickel-molybdate on alumina.

Of the various solvent extraction processes, the most prevalent solvent employed is phenol. Other solvents employed include low boiling point autorefrigerative hydrocarbons, such as propane, propylene, butane, pentane, etc., liquid sulfur dioxide, furfural, and N-methyl-2-pyrrolidones (NMP). NMP is a preferred solvent because it is less toxic in relation to the above-mentioned solvents and requires less energy to effect the extraction.

Generally, when the solvent-extracted raffinate base stocks are dewaxed with a shape-selective molecular sieve, the Viscosity Index (VI) of the product oil is reduced to a greater extent than if the same stocks were solvent dewaxed. This is because shape-selective dewaxing catalysts reduce pour point by cracking normal and near normal paraffins which results in a high concentration of low VI possessing aromatics in the product oil. As a result of having a relatively higher selectivity for cracking normal paraffins versus cracking isoparaffins, some shape-selective molecular sieves are more selective than others in retaining high VI isoparaffins in the oil during dewaxing. For instance, even though the borosilicate molecular sieve disclosed in U.S. Pat. No. 4,269,813 (Klotz) falls in the category of high VI selective catalysts, the VI loss relative to solvent dewaxing is in the range of 8–12 VI units when compared to phenol-extracted SAE 10 raffinate. This loss would have to be compensated for by more severe solvent extraction of aromatics, which is expensive and energy-consuming.

The loss in VI attributed to catalytic hydrodewaxing in comparison to solvent dewaxing is also noted in a paper entitled "Hydrodewaxing of Fuels and Lubricants using ZSM-5 Type Catalysts," by R. G. Graven and J. R. Green, presented at the Australian Institute of Petroleum's 1980 Congress. Therein it is mentioned that the VI for neutral distillate charge stocks dewaxed in the presence of a ZSM-5 catalyst is lower by 3 to 8 units than comparable quality solvent-dewaxed neutrals.

In a paper entitled "Low-Temperature Performance Advantages for Hydrodewaxed Base Stocks and Products," by C. N. Rowe and J. A. Murphy, presented at the 1983 NPRA annual meeting, it is also pointed out that the VI differential between the catalytic dewaxing process disclosed therein and conventional solvent dewaxing ranges between 6 an 10 units for light neutral feedstocks to little or no difference for bright feedstocks.

We have observed that not all solvent raffinates can be subsequently catalytically dewaxed on an equivalent basis. In particular, the high-nitrogen content levels, particularly basic nitrogen compounds, in certain solvent-extracted raffinates are believed to be responsible for the rapid deactivation of the dewaxing catalysts.

For instance, we have found NMP-extracted raffinates to be substantially more difficult to dewax over a shape-selective dewaxing catalyst, i.e., such catalysts typically suffer from a higher deactivation rate when used in the treatment of NMP-extracted raffinates as compared to phenol-extracted raffinates.

In addition, a number of patents and other documents relate to dewaxing of oils using various catalytic materials. For example, U.S. Pat. No. Re. 28,398 (Chen et al.) relates to the dewaxing of oils by shape-selective cracking and hydrocracking over ZSM-5 type zeolites. U.S. Pat. No. 4,360,419 (Miller) discloses a catalytic dewaxing process using a CZH-5 zeolite having a hydrogenation component. U.S. Pat. No. 4,869,806 (Degnan et al.) discloses a catalytic dewaxing process utilizing ZSM-57 as the catalyst. U.S. Pat. Nos. 4,589,976 (Zones); 4,610,854 (Zones); and 4,826,667 (Zones) disclose the use of zeolites SSZ-16, SSZ-15, and SSZ-25, respectively, in hydrocarbon processing, including dewaxing. European Patent Application 0 321 061 discloses catalytic dewaxing of a wax-containing hydrocarbon oil utilizing a crystalline gallium silicate. European Patent Application 0 243 129 discloses selective cracking of a paraffinic hydrocarbon feed using a tectometallosilicate of the Theta-1 type loaded with Re, Ni, Pd or Pt to produce unsaturated hydrocarbons. European Patent Application 0 187 496 discloses a method of preparing gallosilicate zeolites and the use of the catalysts so prepared in various processing schemes including hydrocracking and pour point reduction.

Despite the plethora of catalytic dewaxing processes disclosed in the prior art, there is still the need for an improved catalytic dewaxing process. More specifically, there is a need for a catalytic dewaxing process wherein the yield and viscosity index of the liquid product are increased for a given level of product pour point reduction.

In connection with the present invention, it should be noted that catalysts containing an AMS-type borosilicate molecular sieve coupled with catalytic metal components are known.

For instance, commonly assigned U.S. Pat. No. 4,434,047 (Hensley, Jr. et al.) discloses a catalytic dewaxing hydrotreating process using a catalyst containing a shape-selective zeolite cracking component such as an AMS-type borosilicate molecular sieve, and a hydrogenating component containing Cr, at least one other Group VIB metal and at least one Group VIII metal.

U.S. Pat. No. 4,268,420 (Klotz) similarly discloses an AMS-type crystalline borosilicate which can be used in intimate combination with a hydrogenating component, such as tungsten, vanadium, molybdenum, rhenium, nickel, cobalt, chromium, manganese, or a noble metal, such as platinum or palladium, or rare earth metals, where a hydrogenation-dehydrogenation function is to be performed. The hydrogenation metal can be impregnated on the borosilicate or on a support comprising the crystalline borosilicate suspended in and distributed throughout a matrix of a porous refractory inorganic oxide.

In addition, commonly assigned U.S. Pat. Nos. 4,560,469 (Hopkins et al.) and 4,563,266 (Hopkins et al.) both relate to catalytic dewaxing processes utilizing catalytic compositions comprising a crystalline borosilicate molecular sieve and a hydrogenation component. In '469 the hydrogenation component consists essentially of nickel and in '226 the hydrogenation component includes at least one Group VIII noble metal.

Also, commonly assigned U.S. Pat. Nos. 4,636,299 (Unmuth et al.), 4,728,415 (Unmuth et al.) and 4,755,279 (Unmuth et al.) relate to processes for the manufacture of lubricating oils wherein hydrotreating is followed by treatment in the presence of a dewaxing catalyst composition containing borosilicate molecular sieve. In one specific aspect of the '299 patent, hydrotreatment is preceded by solvent extraction with N-methyl-2-pyrrolidone (NMP) to extract a portion of the aromatic compounds contained in the feed. In one specific embodiment of the '415 patent, the borosilicate molecular sieve is on a silica-alumina-containing matrix and the catalyst composition also contains at least one hydrogenation component from the Group VIB or Group VIII metals. In one specific embodiment of the '279 patent, the catalyst composition contains at least one hydrogenation component of platinum or palladium.

Each of these patents disclose a catalyst composition comprising a borosilicate molecular sieve and a Group VIB or Group VIII hydrogenation metal ('299 and '415 patents) or platinum or palladium ('279 patent). These patents teach that the sequence or order of addition of the respective catalyst components is not critical as these patents contemplate the use of catalysts in which the hydrogenating component is dispersed on the molecular sieve component or on a molecular sieve-matrix component dispersion or on the matrix component of a molecular sieve-matrix dispersion. These patents disclose that the catalyst of each patent can be employed in suitable forms such as spheres, extrudate, pellets, C-shaped or clover leaf-shaped particles.

These patents do not teach, disclose or suggest the use or desirability of a catalytic hydrodewaxing zone having separate sections of two different functioning materials (e.g., cracking function material and hydrogenation function material).

In a paper, entitled "Stepwise Reaction via Intermediates on Separate Catalytic Centers," P. B. Weisz, *Science*, Vol. 123 (1956), pp. 887 through 888, a general criterion for the physical proximity required between two types of catalytic materials was proposed for physical transport processes in heterogenous catalysis systems. According to the paper, the proximity is dependent on the maximum attainable vapor pressure of the intermediate. In a subsequent paper, entitled "Stepwise Reaction on Separate Catalytic Centers: Isomerization of Saturated Hydrocarbons," *Science*, Vol. 126 (1957), pp. 31 through 32, P. B. Weisz et al., reported on work done on catalytic isomerization of paraffin hydrocarbons by acidic solids (e.g., aluminum silicates) impregnated with small amounts of Pt. For the maximum reaction rate for the conversion of n-heptane to iso-heptanes using such materials, the diffusion criterion discussed in the first referenced paper indicated that the particle size should be less than about 100 microns and the experimental results attained were in general agreement with this prediction.

The process of the present invention obviates the rapid deactivation phenomenon described above while simultaneously, surprisingly, increasing the Viscosity Index (VI) and the yield of the lube oil product as well as reducing the pour point of the lube stock.

SUMMARY OF THE INVENTION

A general object of this invention is to provide an improved process for the manufacture of lubricating oils.

It is an object of the present invention to overcome one or more of the problems described above.

The general object of this invention can be attained by a method for reducing the pour point of a hydrocarbon feedstock containing aromatic compounds, sulfur-containing compounds and nitrogen-containing compounds. According to the invention, the hydrocarbon feedstock is passed to a solvent extraction zone wherein a lube oil extraction solvent is used to extract a portion of the aromatic compounds as well as at least a portion of the sulfur-containing compounds and nitrogen-containing compounds contained in the hydrocarbon feedstock, and thereby form an extraction zone raffinate. At least a portion of the extraction zone raffinate is passed to a catalytic hydrodewaxing zone. The catalytic hydrodewaxing zone includes a first section wherein hydrogen is contacted with extraction zone raffinate at catalytic dewaxing conditions in the presence of a first catalyst composition substantially free of Group VIII metals and including a shape-selective molecular sieve to form a catalytically dewaxed product. The catalytic hydrodewaxing zone also includes a second section wherein hydrogen is contacted with at least a portion of the catalytically dewaxed product at hydrogenation conditions in the presence of a second catalyst composition including at least one Group VIII metal hydrogenation component and a porous support material substantially free of acidic crystalline molecular sieve material.

The invention further comprehends methods wherein such a hydrocarbon feedstock is passed to a solvent extraction zone wherein a lube oil extraction solvent is used to extract at least a portion of the aromatic compounds as well as at least a portion of the sulfur-containing compounds and nitrogen-containing compounds contained in a hydrocarbon feedstock, and thereby form an extraction zone raffinate. At least a portion of the extraction zone raffinate is passed to a catalytic hydrodewaxing zone. The catalytic hydrodewaxing zone contains a first section wherein hydrogen is contacted with extracting zone raffinate at catalytic dewaxing conditions in the presence of a first catalyst composition substantially free of Group VIII metals and including a borosilicate molecular sieve to form a catalytically dewaxed product. In a second section of the catalytic hydrodewaxing zone, hydrogen is contacted with at least a portion of the catalytically dewaxed product at hydrogenation conditions in the presence of a second catalyst composition including at least one Group VIII metal hydrogenation component and a porous support material substantially free of acidic crystalline molecular sieve material.

The invention also comprehends a method for reducing the pour point of a hydrocarbon feedstock containing aromatic compounds, sulfur-containing compounds and nitrogen-containing compounds wherein the hydrocarbon feedstock is passed to a solvent extraction zone wherein a lube oil extraction solvent is used to extract at least a portion of the aromatic compounds as well as a portion of the sulfur-containing compounds and nitrogen-containing compounds contained in the feedstock and thereby form an extraction zone raffinate. At least a portion of the extraction zone raffinate is passed to a hydrotreating zone wherein hydrogen is contacted with the raffinate in the presence of hydrotreating catalyst at hydrotreating conditions whereby a substantial portion of the sulfur-containing compounds and nitrogen-containing compounds remaining in the extraction zone raffinate are converted to hydrogen sulfide and ammonia, respectively, to form a hydrotreating zone effluent. At least a portion of the hydrotreating zone effluent is passed to a catalystic hydrodewaxing zone comprising a first and a second section. In the first section, hydrogen is contacted with the hydrotreating zone effluent at catalytic dewaxing conditions in the presence of a first catalyst composition substantially free of Group VIII metals and comprising a shape-selective molecular sieve to form a catalytically dewaxed product. In the second section of the catalytic hydrodewaxing zone, hydrogen is contacted with at least a portion of the catalytically dewaxed product at hydrogenation conditions in the presence of a second catalyst composition comprising at least one Group VIII metal hydrogenation component and an amorphous refractory inorganic oxide support material.

Other objects and advantages of the invention will be apparent to those skilled in the art from the following detailed description taken in conjunction with the appended claims.

BRIEF DESCRIPTION OF THE DRAWING

The figure is a schematic representation of the three catalytic hydrodewaxing zone configurations utilized in the examples contained in the specification.

DETAILED DESCRIPTION OF THE INVENTION

According to the invention, a method for the manufacture of lubricating oils is provided. The method involves reducing the pour point of a hydrocarbon feedstock, e.g., a lubricating oil feedstock, containing aromatic compounds, sulfur-containing compounds and nitrogen-containing compounds. While the invention is described hereinafter with reference to the catalytic hydrodewaxing zone as comprising at least a first and a second section, it is to be understood that by "sections" what is meant is separate and distinct catalyst beds. It is to be understood that such a first and second section can, if desired, be adjoining or adjacent one another. Alternatively, such sections can be suitably physically separated from each other such on separate trays or holders, and with or without an inert material, such as alpha alumina balls or chips.

Without wishing to be bound by theory, it is believed that the process of the invention by separating the "cracking" function material from the "hydrogenation" function material in the manner described results in improved product selectivity, including increased lube yields and liquid product viscosity index, for a given level of product pour point reduction by hindering the diffusive transport of long chain N-paraffin feed components between the catalytic sites associated with the different function materials. In turn, the diffusive transport between the catalytic sites becomes the rate controlling step in the overall dewaxing reaction mechanism.

The invention contemplates the use of a catalytic hydrodewaxing zone comprising at least a first and a second section. In the first section of the hydrodewaxing zone, hydrogen and the material being treated are contacted at catalytic dewaxing conditions and in the presence of a shape-selective molecular sieve-containing catalyst composition which is substantially free of Group VII metals to form a catalytically dewaxed product. In a second section of the hydrodewaxing zone, hydrogen is contacted with at least a portion of the catalytically dewaxed product at hydrogenation conditions and in the presence of a Group VIII metal-containing hydrogenation catalyst composition.

In this fashion, the cracking function served by the shape-selective molecular sieve-containing catalyst composition in the first section is physically separated from Group VIII metals and the hydrogenation function served by the Group VIII metal-containing hydrogenation catalyst composition of the second section. This is in contrast with prior art processes wherein the hydrogenation component and the cracking component are both part of a single catalyst particle, e.g., the molecular sieve material (e.g., a "cracking" function material) contains or has "on" it, such as through metal exchange and/or impregnation, a Group VIII/hydrogenation metal. Thus, with the practice of the invention, the yield and Viscosity Index (VI) of the lube oil product can be increased as compared to lube oil products prepared utilizing catalyst composition(s) wherein there is no physical separation between the catalytic materials effecting the "cracking" function and the "hydrogenation" function.

In greater detail, the catalyst employed in a first section of the catalytic hydrodewaxing zone will preferably contain a shape-selective, pentasil molecular sieve material such as crystalline aluminosilicate (e.g., ZSM-5), silicalite, gallosilicate, or zincosilicate, for example, or preferably, a crystalline borosilicate, or alternatively, another class of molecular sieve material such as mordenite or Beta aluminosilicates, for example.

Crystalline borosilicate molecular sieves of the AMS type are preferred and have the following composition in terms of mole ratios of oxides:

$$0.9\pm0.2M_{2/n}O:B_2O_3:ySiO_2:zH_2O$$

wherein M is at least one cation having a valence of n, y ranges from about 4 to about 600 and z ranges from 0 to about 160, and provide an X-ray diffraction pattern comprising the following X-ray diffraction lines and assigned strengths:

| d - Spacing (Å) | Assigned Strength |
|---|---|
| 11.2 ± 0.2 | W-VS |
| 10.0 ± 0.2 | W-MS |
| 5.97 ± 0.07 | W-M |
| 3.82 ± 0.05 | VS |
| 3.70 ± 0.05 | MS |
| 3.62 ± 0.05 | M-MS |
| 2.97 ± 0.02 | W-M |
| 1.99 ± 0.02 | VW-M |

For ease of reporting X-ray diffraction results, relative intensities (relative peak heights) were arbitrarily assigned the following values:

| Relative Peak Height | Assigned Strength |
|---|---|
| less than 10 | VW (very weak) |
| 10–19 | W (weak) |
| 20–39 | M (medium) |
| 40–70 | MS (medium strong) |
| greater than 70 | VS (very strong) |

These assigned strengths are used throughout this application.

Such crystalline borosilicates typically are prepared by reaction of boron oxide and a silicon-containing material in a basic medium such as a metal or ammonium hydroxide. The preferred borosilicate, by virtue of its generally superior stability and selectivity, is the HAMS-1B type which is in the hydrogen form. Further details with respect to these shape-selective crystalline borosilicate molecular sieve cracking components are found in commonly assigned U.S. Pat. No. 4,269,813 (Klotz) which is incorporated in its entirety herein by reference, wherein the AMS-1B crystalline borosilicate molecular sieve is disclosed.

AMS-1B crystalline borosilicate molecular sieves can also be prepared by crystallizing a mixture of an oxide of silicon, an oxide of boron, an alkylammonium compound and ethylenediamine. This method is carried out in a manner such that the initial reactant molar ratios of water to silica range from about 5 to about 25, preferably about 10 to about 22, and most preferably about 10 to about 15. In addition, preferable molar ratios for initial reactant silica to oxide of boron range from about 4 to about 150, more preferably about 5 to about 80, and most preferably about 5 to about 20. The molar ratio of ethylenediamine to silicon oxide used in the preparation of AMS-1B crystalline borosilicate should be above about 0.05, typically below about 5, preferably about 0.1 to about 1.0, and most preferably about 0.2 to about 0.5. The molar ratio of alkylammonium template compound or precursor to silicon oxide useful in the preparation of this invention can range from 0 to about 1 or above, typically above about 0.001, preferably about 0.005 to about 0.1, and most preferably from about 0.005 to about 0.02. The silica source is preferably a low sodium content silica source containing less than 2,000 ppm Na and most preferably less than 1,000 ppm, such as Ludox AS-40 which contains 40 wt. % $SiO_2$ and 0.08 wt. % $Na_2O$ or Nalco 2327 which has similar specifications.

It is noted that the preferable amount of alkylammonium template compound used in the instant preparation method is substantially less than that required to produce AMS-1B conventionally using an alkali metal cation base.

The borosilicate prepared by the instant method typically contains at least 9,000 ppm boron and less than about 100 ppm sodium and is designated as HAMS-1B-3. The HAMS-1B-3 crystalline borosilicate has a higher boron content and a lower sodium content than crystalline borosilicates formed using conventional techniques.

A second useful class of shape-selective molecular sieve useful according to the present invention is the shape-selective crystalline aluminosilicates molecular sieves of the ZSM type. Suitable crystalline aluminosilicates of this type typically have silica to alumina mole ratios of at least about 12:1 and pore diameters of at least 5 Å. A specific example of a useful crystalline aluminosilicate is the crystalline aluminosilicate ZSM-5, which is described in detail in U.S. Pat. No. 3,702,886. Other shape-selective cracking components contemplated according to the invention include crystalline aluminosilicate ZSM-11, which is described in detail in U.S. Pat. No. 3,709,979; crystalline aluminosilicate ZSM-12, which is described in detail in U.S. Pat. No. 3,832,449; crystalline aluminosilicate ZSM-35, which is described in detail in U.S. Pat. No. 4,016,245; and crystalline aluminosilicate ZSM-38, which is described in detail in U.S. Pat. No. 4,046,859. All of the aforesaid patents are incorporated in their entirety herein by reference. A preferred crystalline aluminosilicate zeolite of the ZSM type is crystalline aluminosilicate ZSM-5, owing to its desirable selectivity and cracking activity.

A third class of shape-selective molecular sieve useful in the process of the present invention is the mordenite-type crystalline aluminosilicate molecular sieves. Specific examples of these are described in detail in U.S. Pat. No. 3,247,098 (Kimberlin), U.S. Pat. No. 3,281,483 (Benesi et al.) and U.S. Pat. No. 3,299,153 (Adams et al.), all of which are incorporated in their entirety herein by reference. Synthetic mordenite-type molecular sieves such as those designated Zeolon and available from the Norton Company are also suitable according to the invention process.

A fourth class of shape-selective molecular sieve useful in the process of the invention is the gallosilicate crystalline molecular sieves such as described in detail in U.S. Pat. Nos. 4,806,701 (Shum); 4,808,763 (Shum); and 4,946,813 (Shum), all of which are incorporated in their entirety herein by reference.

In one embodiment, the crystalline gallosilicate molecular sieves have the following composition in terms of mole ratios of oxides:

$$0.9\pm0.2M_{2/n}O:Ga_2O_3:ySiO_2:zH_2O$$

wherein M is at least one cation, n is the valence of the cation, y is between about 4 and about 600, and z is between O and about 160, and provide X-ray diffraction lines and assigned strengths:

| d - Spacing (Å) | Assigned Strength |
|---|---|
| 11.10 ± 0.20 | VS |
| 9.96 ± 0.20 | MS |
| 6.34 ± 0.20 | W |
| 5.97 ± 0.20 | W |
| 5.55 ± 0.20 | W |
| 4.25 ± 0.10 | VW |
| 3.84 ± 0.10 | MS |
| 3.71 ± 0.10 | M |
| 3.64 ± 0.10 | W |
| 2.98 ± 0.10 | VW |

It is believed that the small gallium content of the sieves is at least, in part, incorporated in the crystalline lattice. Various attempts to remove gallium from the gallosilicate sieves by exhaustive exchange with sodium, ammonium, and hydrogen ions were unsuccessful and therefore, the gallium content is considered nonexchangeable in the instant sieves prepared in the manner described below.

A gallosilicate molecular sieve useful in this invention can be prepared by crystallizing an aqueous mixture, at a controlled pH, of a base, a gallium ion-affording material, an oxide of silicon, and an organic template compound.

Typically, the molar ratios of the various reactants can be varied to produce the crystalline gallosilicates of this invention. Specifically, the molar ratios of the initial reactant concentrations are indicated below:

| | Broad | Preferred | Most Preferred |
|---|---|---|---|
| $SiO_2/Ga_2O_3$ | 4–200 | 10–150 | 20–100 |
| Organic bases/$SiO_2$ | 0.5–5 | 0.05–1 | 0.1–0.5 |
| $H_2O/SiO_2$ | 5–80 | 10–50 | 20–40 |
| Template/$SiO_2$ | 0–1 | 0.01–0.2 | 0.02–0.1 |

By regulation of the quantity of gallium (represented as $Ga_2O_3$) in the reaction mixture, it is possible to vary the $SiO_2/Ga_2O_3$ molar ratio in the final product. In general, it is desirable to have the gallium content of the gallosilicate sieve of this invention between about 0.1 and about 8 percent by weight of gallium. More preferably, the amount of gallium should be between about 0.2 and about 6 weight percent gallium and, most preferably, between about 0.3 and about 4 weight percent of gallium. Too much gallium in the reaction mixture appears to reduce the sieve crystallinity which reduces the catalytic usefulness of the sieve.

More specifically, a material useful in the present invention is prepared by mixing a base, a gallium ion-affording substance, an oxide of silicon, and an organic template compound in water (preferably distilled or deionized). The order of addition usually is not critical although a typical procedure is to dissolve the organic base and the gallium ion-affording substance in water and then add the template compound. Generally, the silicon oxide compound is added with mixing and the resulting slurry is transferred to a closed crystallization vessel for a suitable time. After crystallization, the resulting crystalline product can be filtered, washed with water, dried, and calcined.

During preparation, acidic conditions should be avoided. Advantageously, the pH of the reaction mixture falls within the range of about 9.0 to about 13.0, more preferably between about 10.0 and about 12.0, and most preferably between about 10.5 and 11.5.

Examples of oxides of silicon useful in this invention include silicic acid, sodium silicate, tetraalkyl silicates, and Ludox, a stabilized polymer of silicic acid manufactured by E. I. DuPont de Nemours & Co. Typically, the oxide of gallium source is a water-soluble gallium compound such as gallium nitrate or gallium acetate or another gallium compound, the anion of which is easily removed during sieve calcination prior to use. Water insoluble gallium compounds such as the oxide can be used as well.

Cations useful in the formation of the gallosilicate sieves include the sodium ion and the ammonium ion. The sieves also can be prepared directly in the hydrogen form with an organic base such as ethylenediamine.

The acidity of the gallosilicate sieves of this invention is high as measured by the Hammett $H_o$ function which lies in the neighborhood of about $-3$ to about $-6$.

Organic templates useful in preparing the crystalline gallosilicate include alkylammonium cations or precursors thereof such as tetraalkylammonium compounds, especially tetra-n-propylammonium compounds. A useful organic template is tetra-n-propylammonium bromide. Diamines, such as hexamethylenediamine, can be used.

The crystalline gallosilicate molecular sieve can be prepared by crystallizing a mixture of sources for an oxide of silicon, an oxide of gallium, an alkylammonium compound, and a base such as sodium hydroxide, ammonium hydroxide or ethylenediamine such that the initial reactant molar ratios of water to silica range from about 5 to about 80, preferably from about 10 to about 50, and most preferably from about 20 to about 40. In addition, preferable molar ratios for initial reactant silica to oxide of gallium range from about 4 to about 200, more preferably from about 10 to about 150, and most preferably from about 20 to about 100. The molar ratio of base to silicon oxide should be about above about 0.5, typically below about 5, preferably between about 0.05 and about 1.0 and most preferably between about 0.1 and about 0.5. The molar ratio of alkylammonium compound, such as tetra-n-propylammonium bromide, to silicon oxide can range from 0 to about 1 or above, typically above about 0.005, preferably about 0.01 to about 0.2, most preferably about 0.02 to about 0.1.

The resulting slurry is transferred to a closed crystallization vessel and reacted usually at a pressure at least the vapor pressure of water for a time sufficient to permit crystallization which usually is about 0.25 to about 25 days, typically is about one to about ten days and preferably is about one to about seven days, at a temperature ranging from about 100° to about 250° C., preferably about 125° to about 200° C. The crystallizing material can be stirred or agitated as in a rocker bomb. Preferably, the crystallization temperature is maintained below the decomposition temperature of the organic template compound. Especially preferred conditions are crystallizing at about 165° C. for about three to about seven days. Samples of material can be removed during crystallization to check the degree of crystallization and to determine the optimum crystallization time.

The crystalline material formed can be separated and recovered by well-known means such as filtration with aqueous washing. This material can be mildly dried at varying temperatures, typically about 50° to about 225° C., for a period of time from a few hours to a few days, to form a dry cake which can then be crushed to a powder or to small particles and extruded, pelletized, or made into forms suitable for its intended use. Typically, materials prepared after mild drying contain the organic template compound and water of hydration within the solid mass and a subsequent activation or calcination procedure is necessary, if it is desired to remove this material from the final product. Typically, the mildly dried product is calcined at temperatures ranging from about 260° to about 850° C. and preferably from about 425° to about 600° C. Extreme calcination temperatures or prolonged crystallization times may prove detrimental to the crystal structure or may totally destroy it. Generally, there is no need to raise the calcination temperature beyond about 600° C. in order to remove organic material from the originally formed crystalline material. Typically, the molecular sieve material is dried in a forced draft oven at 165° C. for about 16 hours and is then calcined in air in a manner such that the temperature rise does not exceed 125° C. per hour until a temperature of about 540° C. is reached. Calcination at this temperature usually is continued for about four hours. The gallosilicate sieves thus made generally have a surface area greater than about 300 sq. meters per gram as measured by the BET procedure.

It has been further found, in accordance with the invention, that the gallosilicate molecular sieves that have been treated either by mild atmospheric steaming (e.g., steaming with a steam stream up to 100% steam and at an elevated temperature such as about 1,000° F., for example) for several hours or by subjecting the gallosilicate material to a basic (e.g., $NH_4OH$) autogenous environment at an elevated temperature, e.g., 175° C., for several days such as in an autoclave, provide improved performance in dewaxing, as compared to similar materials not so treated. For example, gallosilicate material so treated results in improved performance such as by further reducing the pour point of the product of a catalytic dewaxing process. It is to be understood, however, that such types of activation treatment of molecular sieves can have application to other molecular sieve materials, in addition to gallosilicates, such as those described above.

Although not required, it is preferred to employ the shape-selective molecular sieve, particularly the above-described borosilicate molecular sieve, combined, dispersed or otherwise admixed in a matrix of at least one nonmolecular sieve, porous refractory inorganic oxide matrix materials as the use of such a matrix material facilitates provision of the ultimate catalyst in a shape or form well suited for process use. Useful matrix materials include alumina, silica, silica-alumina, zirconia, titania, etc., and various combinations thereof and typically will be of a surface area of greater than about 5 $m^2/g$. The matrix material also can contain various adjuncts such as phosphorus oxides, boron oxides and/or halogens such as fluorine or chlorine. Usefully, the molecular sieve-matrix dispersion contains about 1 to 99 wt. %, preferably about 5 to 90 wt. %, and more preferably about 35 to 80 wt. % of the molecular sieve based on the weight of the sieve-matrix dispersion, as such sieve-matrix dispersions generally result in a catalyst that has greater hydrocarbon cracking activity. Thus, in the practice of the invention, preferred shape-selective molecular sieve catalysts, in addition to at least one shape-selective molecular sieve, comprise at least one nonmolecular sieve, porous refractory inorganic oxide matrix material.

Methods for dispersing molecular sieve materials within a matrix material are well-known to persons skilled in the art and applicable with respect to the shape-selective molecular sieve material and in particular to the borosilicate molecular sieve materials employed according to the present invention. A preferred method is to blend the shape-selective molecular sieve, preferably in a finely divided form, into a sol, hydrosol or hydrogel of an inorganic oxide, and then add a gelling medium such as ammonium hydroxide to the blend with stirring to produce a gel. The resulting gel can be dried, dimensionally formed if desired, and calcined. Drying is typically conducted in air at a temperature of about 80° to about 350° F. (about 27° to about 177° C.) for a period of several seconds to several hours. Calcination is typically conducted by heating in air at about 800° to about 1,200° F. (about 427° to about 649° C.) for a period of time ranging from about ½ to about 16 hours.

Another suitable method for preparing a dispersion of shape-selective molecular sieve in a porous refractory oxide matrix material is to dry blend particles of each, preferably in finely divided form, and then to dimensionally form the dispersion if desired.

As described above, the catalyst composition of the first section is substantially free of Group VIII metals, such as Ni, Pd, Pt, Rh, Ir, etc. It is to be understood that by "substantially free" what is meant is that the composition excludes amounts of the specified materials which materially affect the effectiveness of the composition in the specified processing. Thus, "substantially free" generally means that the composition contains no more than contaminant amounts of the specified materials, typically the composition contains an amount of no more than about 0.05 wt. % and more specifically the composition contains an amount of no more than about 0.01 wt. % of the specified material.

Catalytic dewaxing conditions employed, according to the present invention, vary somewhat depending upon the choice of feed material. In general, however, the temperature ranges from about 400° to about 800° F., the total pressure ranges from about 100 to about 3,000 psig, hydrogen partial pressure ranges from about 50 to about 2,500 psig, linear hourly space velocity (LHSV) ranges from about 0.1 to about 20 volumes of feed per volume of catalyst per hour (reciprocal hours) and the hydrogen addition rate ranges from about 500 to about 20,000 standard cubic feet per barrel (SCFB). Operation within these parameter ranges generally results in the process producing products having larger pour point reductions while minimizing any reduction in product lube yield or VI.

Contacting the hydrocarbon feed with hydrogen under the aforesaid conditions can be conducted using either a fixed or expanded bed of catalyst in a single reactor or a series of reactors as desired.

The catalyst employed in the second section of the catalytic hydrodewaxing zone will generally comprise at least one Group VIII metal hydrogenation component, preferably the Group VIII metal will be a noble metal, more preferably a noble metal selected from the group of Rh, Pd, Ir and Pt, with Pd and Pt being especially preferred. For ease of preparation and handling, as well as to achieve a better dispersion of the hydrogenation metal to increase the catalytically effective surface area of the material, the catalyst employed in the second section preferably will also contain a support. When a support is used, the catalyst for the second section will generally contain about 0.1 to about 10 wt. %, preferably about 0.2 to about 5 wt. %, and more preferably about 0.5 to about 1 wt. % of the Group VIII metal (on an elemental basis) to result in a catalyst with improved hydrogenation activity.

Supports of amorphous refractory inorganic oxides such as alumina, silica-alumina, silica or other porous material substantially free of acidic crystalline molecular sieves (e.g., typically containing no more than about 0.1 wt. % acidic crystalline molecular sieve material based on the total weight of the catalyst composition) which may contribute to hydrocarbon cracking, will be preferred. The support material will typically have a surface area of more than about 5 $m^2/g$. In one aspect of the subject invention, second section catalyst compositions of Pt on alumina and Pd on alumina have been found to be particularly useful as relatively high dispersions and facile reductions can be realized with such compositions.

The hydrogenation metal can be associated with such a support material by impregnation of the support material. The mechanics of impregnating the support material with solutions of compounds convertible to metal oxides upon calcination are well-known to persons skilled in the art and generally involve forming solutions of appropriate compounds in suitable solvents, preferably water, and then contacting the support material with an amount or amounts of solution or solutions sufficient to deposit appropriate amounts of metal or metal salts onto the support material. Useful metal compounds convertible to metal oxides are well-known to persons skilled in the art and include various ammonium salts, as well as metal acetates, nitrates, anhydrides, etc.

In the practice of the invention, the separation of the catalysts can be further varied by the inclusion of a varying amount of inert nonporous diluent (e.g., alpha-alumina) with the catalysts. Diluent materials will generally have a surface area of no more than about 5 $m^2/g$, and typically will have a surface area of less than about 1 $m^2/g$. In practice, to avoid detrimentally affecting the amount or quality of product from the process, a ratio of no more than about one part diluent to about one part catalyst will be used with a ratio of no more than about one part diluent to about two parts catalyst being preferred, and with a ratio of no more than about one part of diluent to about ten parts of catalyst being more preferred. (Such ratios being on a weight basis.)

Hydrogenation conditions employed according to the invention, will also vary somewhat depending on the choice of feed material. In general, the hydrogenation conditions (e.g., total pressure ranges, hydrogen partial pressure ranges, linear hourly space velocity (LHSV) ranges and hydrogen addition rate ranges) employed in the second section of the catalytic hydrodewaxing zone will generally be similar to the catalytic dewaxing conditions described above for use in the first section. The temperature employed in the second section, however, will generally be less than 500° F., with the temperature in the second section being at least about 10° F. cooler, preferably at least about 50° F., and more preferably at least about 100° F. cooler than that used in the first section.

Hydrocarbon feed materials employed according to the invention include whole petroleum or synthetic crude oils, coal or biomass liquids, or fractions thereof. Narrower feedstock fractions for use in the practice of the invention include fuel oils, waxy lube oil distillates, waxy lube oil solvent raffinates and lube oil distillates or raffinates which have been previously partially dewaxed by solvent dewaxing, e.g., toluene-methyl-ethyl ketone or propane dewaxing. Such narrower feedstock fractions are preferred for use in the practice of the invention such as where the processing has narrow restrictions or stringent specifications imposed on the end products, e.g., applications such as food grade oils, medicinal white oils, etc.

The process of the invention gives particularly good results with feeds, including the narrower feedstock fractions discussed above, which contain sufficiently high levels of waxy components as to exhibit pour points of at least about 30° F. In practice, the feed to the process of the invention will typically have a wax content of at least about 10 wt. % and more typically have a wax content of at least about 20 wt. %.

Preferred feed materials for preparation of lube oil base stocks by the process of the invention are distillate fractions boiling above about 500° F. and having pour points of about 50° to about 130° F. In the practice of the invention, it is preferred that the feed to the catalytic hydrodewaxing zone comprise long chain waxy paraffins (e.g., no more than about 20 wt. % of $C_{10}$-paraffin compounds) with little or no aromatic compounds (e.g. less than about 25 vol. %, preferably about 15 vol. % or less of aromatic compounds) as such a feed is generally easier to crack and to result in a product with a higher VI, as compared to similar processing of a feed containing significant amounts of short chain paraffins (e.g., more than about 20 wt. % of $C_{10}$-paraffin compounds) and/or with significant portions of aromatic compounds (e.g., more than about 15 vol. % of aromatic compounds).

Both vacuum and atmospheric distillate fractions are contemplated for use according to the invention as are deasphalted resids or other fractions that have been hydrotreated or hydrocracked to reduce boiling point and/or remove impurities such as sulfur, nitrogen, oxygen or metals. While such feeds are contemplated, it should be understood that the feed materials employed according to the invention can contain appreciable levels of impurities such as sulfur, nitrogen and/or oxygen. For example, up to about 1 wt. % sulfur, 1,000 ppm nitrogen and/or about 50 vol. % aromatic carbon material ($C_A$) can be present in the feed.

The material subjected to the catalytic hydrodewaxing of the invention can be a material resulting from one or more pretreatment processing steps. For example, for processing of aromatic-containing hydrocarbon feedsticks containing about 1,000 to 10,000 ppm of sulfur-containing compounds and/or about 100 to 1,000 ppm of nitrogen-containing compounds, a treatment step of solvent extraction wherein the hydrocarbon feedstock is passed to a solvent extraction zone wherein a lube oil extraction solvent is used to extract a portion of the aromatic compounds contained in the hydrocarbon feedstock is preferred. Typically, such extraction also serves to extract a portion of the sulfur- and nitrogen-containing compounds contained in the hydrocarbon feedstock. Generally, such extraction results in an extraction zone raffinate with a $C_A$ of less than about 25 vol. % and preferably less than about 15 vol. %, with or without other appropriate pretreatment, e.g., hydrotreatment. Generally, a processing scheme of catalytic hydrodewaxing in accordance with the invention and preceded by solvent extraction without intermediate catalytic hydrotreatment has particular utility in the processing of aromatic compound containing hydrocarbon feedstocks containing about 25 to 50 vol. % aromatic compounds, as well as 1,000 to 3,000 ppm of sulfur-containing compounds and/or 100 to 300 ppm of nitrogen-containing compounds.

Such aromatic solvent extraction can be carried out with a lube oil extraction solvent, as described above, such as phenol, low boiling point autorefrigerative hydrocarbons, such as propane, propylene, butane, pentane, etc., liquid sulfur dioxide, furfural, and N-methyl-2-pyrrolidone (NMP). Preferably, however, N-methyl-2-pyrrolidone (NMP) is used in the extraction of a portion of the aromatic compounds contained in the hydrocarbon feedstock to form an extraction zone raffinate as NMP is generally less toxic than the other above-mentioned solvents and requires less energy to effect the extraction. In addition, NMP-extracted raffinates are not equivalent to other solvent extracted raffinates in that they have been found to rapidly deactivate a dewaxing catalyst. The NMP-extracted raffinates also have a relatively high basic nitrogen compound content especially when compared with phenol-extracted raffinates.

While the solvent extraction processing of the invention is described hereinafter with particular reference to extraction using NMP as the extraction solvent, it is to be understood that other extraction solvents, such as those identified hereinabove, can in a like manner also be used in the practice of the invention.

The extraction step of the present invention (e.g., NMP solvent extraction) can be carried out in a conventional fashion to extract a portion of the aromatic compounds present in the hydrocarbon feedstock. Optionally, the extraction zone raffinate phase can be processed to remove entrained and dissolved solvent.

Solvent ratios, such as those varying from 0.5 volume of solvent recycled per volume of feed to 5 volumes of solvent recycled per volume of feed, can be employed. Extraction is typically carried out in a number of counter-current washing stages. Columns containing perforated plates, bubble caps, and channel trays, similar to those used for distillation operations are often employed. Another typical contacting device is a Shell rotating disc contactor. The subject contactor consists of a vertical vessel fitted with a series of stator rings fixed to the wall together with a central rotating shaft carrying a number of discs, one to each of the compartments formed by the stator rings.

While the borosilicate-containing dewaxing catalyst is generally more nitrogen resistant than conventional aluminosilicate-containing dewaxing catalysts, basic nitrogen compounds, such as NMP contained in NMP-extracted raffinates, can result in premature deactivation of the borosilicate catalyst. Hence, in accordance with one highly preferred aspect of the present invention, the effluent from an NMP extraction zone is hydrotreated to reduce the amount of nitrogen, specifically basic nitrogen compounds, contained in the dewaxing zone influent. The sulfur content of the dewaxing zone influent is likewise reduced in the hydrotreating zone, thereby reducing any sulfur poisoning of the hydrogenation component in the dewaxing catalyst. It is believed this results in increased aromatics saturation in the dewaxing zone resulting in an increase in VI of the lube base stock.

Suitable operating conditions in the hydrotreating zone are summarized in Table 1.

TABLE 1

HYDROTREATING OPERATING CONDITIONS

| Conditions | Broad Range | Preferred Range |
|---|---|---|
| Temperature, °F. | 400–850 | 500–750 |
| Total pressure, psig | 50–4,000 | 400–1,500 |
| LHSV, $hr^{-1}$ | 0.10–20 | 0.25–2.5 |
| Hydrogen rate, SCFB | 500–20,000 | 800–6,000 |
| Hydrogen partial pressure, psig | 50–3,500 | 400–1,000 |

The hydrotreater is also preferably operated at conditions that will result in a liquid effluent stream having less than 10 ppm nitrogen-containing impurities, based on nitrogen, and less than 20 ppm sulfur-containing impurities, based on sulfur, and most preferably less than 5 ppm and 10 ppm, respectively. The above set-out preferred nitrogen and sulfur contents correspond to substantial conversion of the sulfur and nitrogen compounds entering the hydrotreater.

The catalyst employed in the hydrotreater can be any conventional and commercially available hydrotreating catalyst. The subject hydrotreating catalysts typically contain one or more elements from Groups IIB, VIB, and VIII supported on an inorganic refractory support such as alumina. Catalysts containing NiMo, NiMoP, CoMo, CoMoP, and NiW are most prevalent.

Other suitable hydrotreating catalysts for the hydrotreating stage of the present invention comprise a Group VIB metal component or a non-noble metal component of Group VIII and mixtures thereof, such as cobalt, molybdenum, nickel, tungsten and mixtures thereof. Suitable supports include inorganic oxides such as alumina, amorphous silica-alumina, zirconia, magnesia, boria, titania, chromia, beryllia, and mixtures thereof. The support can also contain up to about 20 wt. % zeolite based on total catalyst weight. A preferred hydrotreating catalyst contains sulfides or oxides of Ni and Mo composited with an alumina support wherein the Ni and Mo are present in amounts ranging from 0.1 to 20 wt %, calculated as $MoO_3$, based on total catalyst weight.

Prior to the dewaxing in accordance with a preferred aspect of the present invention, the $H_2S$ and $NH_3$ gases are stripped from the hydrotreater effluent in a conventional manner in a gas-liquid separation zone.

Thus, in one embodiment of the invention, after such solvent extraction treatment and prior to catalytic hydrodewaxing treatment, at least a portion of the extraction zone raffinate is passed to a hydrotreating zone. In the hydrotreating zone, hydrogen is contacted with the extraction zone raffinate in the presence of a hydrotreating catalyst at hydrotreating conditions to convert at least a substantial portion of the sulfur-containing compounds and nitrogen-containing compounds remaining in the extraction zone raffinate to hydrogen sulfide and ammonia, respectively, forming a hydrotreating zone effluent. At least a portion of the hydrotreating effluent is then subsequently passed and subjected to the catalytic hydrodewaxing zone for treatment.

Such a processing scheme, involving the pretreatment steps of solvent extraction followed by catalytic hydrotreatment, will typically be preferred when the aromatic compound containing hydrocarbon feedstock (typically containing about 25 to 50 vol. % aromatic compounds) contains about 3,000 to 10,000 ppm of sulfur-containing compounds and/or 300 to 1,000 ppm of nitrogen-containing compounds. It being understood that in accordance with the invention, the processing of an aromatic compound containing hydrocarbon feedstock (typically containing about 25 to 50 vol. % aromatic compounds) containing no more than about 3,000 ppm of sulfur-containing compounds and no more than about 300 ppm of nitrogen-containing compounds can proceed via solvent extraction, followed by catalytic hydrodewaxing, as described above, without the need for intermediate hydrotreatment.

Thus, the catalytic hydrodewaxing processing described hereinabove can be included as a part of the multistep process for the preparation of lube oils wherein catalytic hydrodewaxing is conducted in combination with other processing steps such as solvent extraction, deasphalting, solvent dewaxing, hydrodewaxing and/or hydrotreating to obtain lube oil based products of relatively low pour point and high viscosity index and stability. Moreover, it is to be understood that the process and the catalyst compositions of the invention illustratively disclosed herein can, if desired, be suitably practiced in the absence of any step or element, respectively, which is not specifically disclosed herein.

The present invention is described in further detail in connection with the following examples, it being understood that these examples are for purposes of illustration and not limitation.

EXAMPLE 1

Generation of NMP-Extracted Raffinate

An NMP-extracted SAE 10 raffinate was prepared using a commercial NMP extraction unit. Significant properties for the 10 distillate feed and the 10 raffinate extraction product are identified in Table 2.

TABLE 2

| | Feed | NMP-Extracted Raffinate |
|---|---|---|
| BP, °F. | 600–1,000 | 605–1,005 |
| S, wt. % | 0.5–0.8 | 0.13–0.20 |
| N, ppm | 200–300 | 20–80 |
| Pour Point, °F. | 80–90 | 90–100 |
| Vis @ 100° C., cSt | 5–6 | 4.5–5.5 |
| VI | 70–85 | 105–120 |
| Mass - Spec HCTA Aromatics, vol. % | 28–35 | 8–13 |

EXAMPLE 2

Generation of Hydrotreated NMP-Extracted Raffinate

The NMP-extracted SAE 10 raffinate of Example 1 was hydrotreated in a fixed bed, downflow, pilot plant associated with automatic controls to maintain constant flow of gas and feed in constant temperature and pressure. The feed was hydrotreated with HDS-3A, a commercially available $NiMo/Al_2O_3$ hydrotreating catalyst from Criterion Catalyst Co., at a total unit pressure of 805 psig, a temperature of 672° F. and a liquid feed rate of 1 volume of feed per volume of catalyst per hour (LHSV) at a constant gas flow rate corresponding to 800 standard cubic feet per barrel (SCFB). The product was collected over several days and stripped of $H_2S$ in a 5 gallon tank with nitrogen until $H_2S$ could not be detected using a Drager tube.

The properties of the feed to the hydrotreater and a hydrotreated product are set out below in Table 3.

TABLE 3

| | NMP SAE 10 Raffinate | Hydrotreated NMP SAE 10 Raffinate |
|---|---|---|
| Gravity, °API | 32 | 33.4 |
| Pour Point, °F. | 95 | 95 |
| VI | 115 | 114 |
| Vis @ 40° C., cSt | 25.12 | 22.70 |
| Vis @ 100° C., cSt | 4.84 | 4.54 |
| Carbon, wt. % | 85.68 | 86.05 |

TABLE 3-continued

| | NMP SAE 10 Raffinate | Hydrotreated NMP SAE 10 Raffinate |
|---|---|---|
| Hydrogen, wt. % | 13.79 | 13.96 |
| Sulfur, ppm | 1410 | 1.2 |
| Nitrogen, ppm | 33 | 1.0 |
| ASTM color | — | <0.5 |
| Mass - Spec HCTA, vol. % | | |
| Aromatic | 10.2 | 8.4 |
| Saturates | 89.8 | 91.6 |

EXAMPLE 3

Catalyst Preparation

HAMS-$Al_2O_3$ Catalyst

An AMSAC 3400 borosilicate molecular sieve-containing catalyst contained 40 wt. % HAMS-IB-3 molecular sieve and 60 wt. % PHF alumina and was prepared using prior art methods (see European Patent No. 0 184 461 and U.S. Pat. No. 4,725,570, the disclosures of which are incorporated herein in their entirety). The catalyst was ion exchanged in 10 wt. % ammonium acetate solution at 100° C. followed by one hour of stirring and a one hour water wash at 100° C. with stirring. Ten-to-one solution-to-catalyst weight ratios were used. The ion exchanged catalyst was then flushed ten times with 1:1 V/V ratios of fresh water, dried overnight at 250° F., and then calcined for 3 hours at 932° F.

Pd-$Al_2O_3$ Catalyst

A commercially available American Cyanamid PHF-5A alumina blank was dried overnight at 250° F., then calcined at 932° F. for 1 hour. The alumina blank was then impregnated with palladium to a 0.5 wt. % loading by the incipient wetness technique using a Pd nitrate source (Engelhard, Pd (II) nitrate in nitric acid, 10 wt. % Pd). Ammonium acetate (5 wt. %) was also added to the Pd solution as an impregnation aid. The impregnated catalyst was dried overnight at 250° F. and calcined for 3 hours at 932° F.

Pd-HAMS-$Al_2O_3$ Catalyst

A commercially prepared sample of catalyst containing 0.5 wt. % Pd on a support (referred to as AMSAC 3400) of 40 wt. % HAMS-1B-3 molecular sieve and 60 wt. % PHF alumina was prepared from the same AMSAC 3400 base described above and was also ion exchanged as described above prior to Pd impregnation.

$Al_2O_3$—Alumina Blank

A commercially available PHF-5A alumina blank from American Cyanamid Co. was used.

Table 4 shows the properties of the four tested materials.

TABLE 4

| | HAMS-$Al_2O_3$ | $Al_2O_3$ | Pd-HAMS-$Al_2O_3$ | Pd—$Al_2O_3$ |
|---|---|---|---|---|
| HAMS-1B-3, wt. % | 40 | 0 | 40 | 0 |
| PHF $Al_2O_3$, wt. % | 60 | 100 | 60 | 100 |
| Na, ppm | <66[a] | — | 49 | — |
| Wet Chem B, wt. % | 0.35 | — | 0.35 | — |
| XRD % Cryst HAMS (35% Std 6232-73-1) | 19 | — | 16 | — |
| $N_2$ Desorption | | | | |
| BET, $m^2/g$ | 327 | 198 | 339 | 202 |
| Pore Volume, cc/g | 0.89 | 0.60 | 0.97 | 0.59 |

TABLE 4-continued

| | HAMS-$Al_2O_3$ | $Al_2O_3$ | Pd-HAMS-$Al_2O_3$ | Pd—$Al_2O_3$ |
|---|---|---|---|---|
| Pd, wt. % | 0 | 0 | 0.42 | 0.48 |
| CO Uptake, [b] cc/g cat | — | — | 0.12 | 0.49 |
| Pd Surface Area, $m^2$/g cat | — | — | 0.26 | 1.05 |
| Calculated Pd Dispersion, % | — | — | 12 | 48 |

[a]66 ppm Na prior to hot $NH_4Ac$ exchange procedure.
[b]10% CO/He uptake at room temperature following calculation @ 250° C. (1 hour) + reduction @ 250° C. (1 hour).

EXAMPLE 4

The Figure is a schematic representation of the three catalytic hydrodewaxing zone configurations (configurations A, B and C) used to treat the hydrotreated NMP-extracted SAE 10 raffinate of Example 2. All catalysts in configurations A, B and C were pre-dried at 932° F. for 1 hour prior to loading. All catalyst beds in Configurations A, B, and C were diluted with 10/20 mesh nonporous alpha-alumina diluent in the ratio of two weight parts catalyst to one weight part diluent. Each configuration is described below:

Configuration A was a control and consisted of two separate beds: a top bed containing 40 cc (17.1 g) of the HAMS-$Al_2O_3$ catalyst from Example 3 (plus diluent) and a bottom bed containing 40 cc (24.4 g) of $Al_2O_3$ from Example 3 (plus diluent). The two beds were separated by one inch of diluent, and the overall length of the catalyst zone (from the top of the top bed to the bottom of the bottom bed) was 12 inches.

Configuration B was a control and consisted of two separate beds: a top bed containing 40 cc (17.4 g) of Pd-HAMS-$Al_2O_3$ catalyst from Example 3 (plus diluent) and a bottom bed containing 40 cc (24.5 g) of $Al_2O_3$ catalyst from Example 3 (plus diluent). The two beds were separated by one inch of diluent, and the overall length of the catalyst zone was 12 inches.

Configuration C illustrates the invention and consisted of two separate beds: a top bed containing 40 cc (17.4 g) of HAMS-$Al_2O_3$ catalyst from Example 3 (plus diluent) and a bottom bed containing 40 cc (25.3 g) of Pd-$Al_2O_3$ catalyst from Example 3 (plus diluent). The two beds were separated by one inch of diluent, and the overall length of the catalyst zone was 12 inches.

The testing was done in a fixed bed, downflow, pilot plant reactor (ID = ⅜ inch) with once through hydrogen and an internal travelling thermocouple. The pilot plant also included associated automatic controls to maintain a constant flow of gas and feed, as well as a constant temperature and pressure. Oil flow was 40 cc/hr, with a liquid feed rate of 1 volume of feed per volume of catalyst per hour (LHSV) maintained in each bed. During initial line out on oil (70–90 hours), reactor temperature was 550° F., except for Configuration A, wherein the reactor temperature was 570° F. Once the line out period was complete, the reactor temperature was stabilized to obtain dewaxed product having a pour point of about 5° to about 15° F.

Dewaxing feedstock was passed over the catalyst with a positive displacement pump. Once-through inlet hydrogen was metered with a mass flow controller. Off-gas was manually sampled and analyzed by gas chromatogram.

Liquid products were vacuum distilled into naphtha, distillate, and lube oil fractions. The lube oil cut point was set to meet lube oil viscosity specifications. Daily weight balances were logged into a SAS data base and weight balance program. Lube yields based on feed were calculated neglecting naphtha losses during distillation, typically less than 3–5 wt. %.

Table 5 gives the activity and selectivity results for each of the tested configurations.

Table 6 gives the ASTM Color results for the feed and the products of the three tested reactor configurations (the two control configurations and the configuration in accordance with one embodiment of the invention).

TABLE 5

| | Feed | A Control | B Control | C Invention | |
|---|---|---|---|---|---|
| Activity | | | | | |
| Hours on Oil | — | 96 | 170 | 138 | 162 |
| Pressure, psig | — | 800 | 800 | 800 | 800 |
| LHSV[a], $hr^{-1}$ | — | 1.0 | 1.0 | 1.0 | 1.0 |
| Off-Gas, SCFB | — | 2300 | 2480 | 2460 | 2440 |
| Temperature, °F. | — | 577 | 488 | 575 | 575 |
| Lube Pour, °F. | 95 | 5 | 15 | 15 | 15 |
| Selectivity | | | | | |
| Lube VI | 114 | 86 | 86 (87)[b] | 89 | 90 |
| KV @ 40° C., cSt | 22.70 | 32.70 | 32.24 (32.26) | 31.66 | 31.50 |
| KV @ 100° C., cSt | 4.54 | 5.23 | 5.20 (5.20) | 5.18 | 5.17 |
| Lube API | 33.4 | 32.8 | 33.8 | 33.0 | 33.1 |
| $C_1$, wt. % | — | 0.06 | 0.01 | 0.06 | 0.06 |
| $C_2$, wt. % | — | 0.14 | 0.05 | 0.15 | 0.15 |
| $C_3$, wt. % | — | 3.38 | 5.01 | 3.71 | 3.46 |
| $C_4$, wt. % | — | 4.49 | 5.53 | 5.12 | 4.74 |
| $C_5$,-Naphtha, wt. % | — | 18.20 | 14.90 | 17.87 | 17.31 |
| Distillate, wt. % | — | 0.00 | 0.00 | 0.00 | 0.00 |
| Lube Oil, wt. % | 100 | 75.37 | 69.66 | 76.92 | 77.52 |
| Recovery, wt. % | — | 103.3 | 96.8 | 105.7 | 105.1 |

[a]LHSV per bed, 40 cc/hr oil flow
[b]Parentheses are repeat analyses.

TABLE 6

| Material | ASTM Color |
|---|---|
| Feed | <0.5 |
| A Product | 2.5 |
| B Product | <0.5 |
| C Product | 1.5 |

Discussion of Results

As shown in Table 5, product lube yield was higher using Configuration C (i.e., an embodiment in accordance with the invention wherein in a first section hydrogen is contacted with the material being treated at catalytic dewaxing conditions and in the presence of a shape-selective molecular sieve-containing catalyst composition followed by contacting such catalytically dewaxed product at hydrogenation conditions and in the presence of a Group VIII metal hydrogenation component-containing catalyst composition), as compared with the two control configurations, A and B (i.e., lube yields of 76.92 wt. % and 77.52 wt. % for Configuration C, as compared to lube yields of 75.37 wt. % and 69.66 wt. % with Configurations A and B, respectively).

Also, operation with Configuration C resulted in a product having a higher Viscosity Index (VI) as compared to the product of operation with the control configurations (i.e., analyses of the product of operation of Configuration C resulted in lube VI's of 89 and 90 as compared to a lube VI of 86 for the product of operation with Configuration A and lube VI's of 86 and 87, respectively, for the product of operation with Configuration B). Such a difference in lube VI is of practical commercial significance as, for example, it can reduce or eliminate the need for the addition to the lube oil of relatively expensive VI enhancers.

The activity realized with Configuration C was about the same as that realized using the control, Configuration A, requiring a reactor temperature of about 575° F. to achieve a lube product having a pour point temperature of 5° to 15° F. The activity realized using the control, Configuration B, was only moderately higher than that of Configuration C, e.g., a temperature of only 488° F. was required to achieve a 15° F. pour point product.

As shown in Table 6, both Configurations B and C produce products having acceptable Product ASTM Color readings of 1.5 or less. In contrast, the control, Configuration A produced a product having an unacceptably high Product ASTM Color reading of 2.5.

The foregoing detailed description is given for clearness of understanding only, and no unnecessary limitations are to be understood therefrom, as modifications within the scope of the invention would be obvious to those skilled in the art.

That which is claimed is:

1. A method for reducing the pour point of a hydrocarbon feedstock containing aromatic compounds, sulfur-containing compounds and nitrogen-containing compounds, said method comprising the steps of:

passing the hydrocarbon feedstock to a solvent extraction zone wherein a lube oil extraction solvent is used to extract a portion of the aromatic compounds as well as at least a portion of the sulfur-containing compounds and nitrogen-containing compounds contained in the hydrocarbon feedstock and thereby form an extraction zone raffinate; and passing at least a portion of the extraction zone raffinate to a catalytic hydrodewaxing zone comprising;

(a) a first section wherein hydrogen is contacted with extraction zone raffinate at catalytic dewaxing conditions at a dewaxing temperature greater than 500° F. in the presence of a first catalyst composition substantially free of Group VIII metals and comprising a shape-selective molecular sieve selected from the group consisting of gallosilicates, silicalites, zincosilicates, crystalline borosilicates, crystalline aluminosilicates, mordenites or beta aluminosilicates to form a catalytically dewaxed product, and (b) a second section wherein hydrogen is contacted with at least a portion of the catalytically dewaxed product at hydrogenation conditions at a hydrogenation temperature less than 500° F. and at least 10° F. less than the dewaxing temperature in the presence of a second catalyst composition comprising at least one Group VIII metal hydrogenation component and an amorphous refractory inorganic oxide support material.

2. The method of claim 1 wherein said hydrocarbon feedstock contains at least about 3,000 ppm of sulfur-containing compounds and at least about 300 ppm of nitrogen-containing compounds, said method additionally comprising the step of passing at least a portion of the extraction zone raffinate to a hydrotreating zone wherein hydrogen is contacted with the extraction zone raffinate in the presence of a hydrotreating catalyst at hydrotreating conditions wherein a substantial portion of the nitrogen- and sulfur-containing compounds remaining in the extraction zone raffinate are converted to hydrogen sulfide and ammonia, respectively, to form a hydrotreating zone effluent, which is subsequently passed and subjected to the catalytic hydrodewaxing zone.

3. The method of claim 1 wherein the shape-selective molecular sieve comprises a ZSM crystalline aluminosilicate.

4. The method of claim 1 wherein the shape-selective molecular sieve comprises a crystalline gallosilicate molecular sieve.

5. The method of claim 1 wherein the shape-selective molecular sieve comprises a crystalline borosilicate molecular sieve.

6. The method of claim 5 wherein the crystalline borosilicate molecular sieve comprises HAMS-1B crystalline borosilicate molecular sieve.

7. The method of claim 1 wherein the Group VIII metal hydrogenation component comprises Pd.

8. The method of claim 1 wherein the Group VIII metal hydrogenation component comprises Pt.

9. The method of claim 1 wherein the hydrocarbon feedstock has a pour point at least about 30°.

10. A method for reducing the pour point of a hydrocarbon feedstock containing aromatic compounds, sulfur-containing compounds and nitrogen-containing compounds, said method comprising the steps of:

passing the hydrocarbon feedstock to a solvent extraction zone wherein a lube oil extraction solvent is used to extract at least a portion of the aromatic compounds as well as at least a portion of the sulfur-containing compounds and nitrogen-containing compounds contained in the hydrocarbon feedstock and thereby form an extraction zone raffinate, and passing at least a portion of the extraction zone raffinate to a catalytic hydrodewaxing zone comprising;

(a) a first section wherein hydrogen is contacted with extraction zone raffinate at catalytic dewaxing conditions in the presence of a first catalyst composition substantially free of Group VIII metals and comprising a borosilicate molecular sieve to form a catalytically dewaxed product, and (b) a second section wherein hydrogen is contacted with at least a portion of the catalytically dewaxed product at hydrogenation conditions in the presence of a second catalyst composition comprising at least one Group VIII metal hydrogenation component and an a porous support material substantially free of acidic crystalline molecular sieve material.

11. The method of claim 10 wherein the borosilicate molecular sieve comprises HAMS-1B crystalline borosilicate molecular sieve.

12. The method of claim 10 wherein said hydrocarbon feedstock contains at least about 3,000 ppm of sulfur-containing compounds and at least about 300 ppm of nitrogen-containing compounds, said method additionally comprising the step of passing at least a portion of the extraction zone raffinate to a hydrotreating zone wherein hydrogen is contacted with the extraction zone raffinate in the presence of a hydrotreating catalyst at hydrotreating conditions wherein a substantial portion of the sulfur-containing compounds and nitrogen-containing compounds remaining in the extraction zone raffinate are converted to hydrogen sulfide and ammonia, respectively, to form a hydrotreating zone effluent which is subsequently passed and subjected to the catalytic hydrodewaxing zone.

13. The method of claim 12 wherein said hydrocarbon feedstock contains no more than about 10,000 ppm of sulfur-containing compounds, no more than about 1,000 ppm of nitrogen-containing compounds and no more than about 50 vol. % of aromatic carbon-containing compounds.

14. The method of claim 10 wherein said hydrocarbon feedstock contains no more than about 3,000 ppm of sulfur-containing compounds, no more than about 300 ppm of nitrogen-containing compounds and no more than about 50 vol. % of aromatic carbon-containing compounds.

15. The method of claim 10 wherein the Group VIII metal is a noble metal.

16. The method of claim 15 wherein the component of the Group VIII noble metal comprises about 0.1 to about 10 wt. % of the second catalyst composition.

17. The method of claim 10 wherein the hydrocarbon feedstock has a pour point of at least about 30° F.

18. A method for reducing the pour point of a hydrocarbon feedstock containing aromatic compounds, sulfur-containing compounds and nitrogen-containing compounds, said method comprising the steps of:

passing the hydrocarbon feedstock to a solvent extraction zone wherein a lube oil extraction solvent is used to extract at least a portion of the aromatic compounds as well as at least a portion of the sulfur-containing compounds and nitrogen-containing compounds contained in the hydrocarbon feedstock and thereby form an extraction zone raffinate, passing at least a portion of the extraction zone raffinate to a hydrotreating zone wherein hydrogen is contacted with the extraction zone raffinate in the presence of a hydrotreating catalyst at hydrotreating conditions whereby a substantial portion of the sulfur-containing compounds and nitrogen-containing compounds remaining in the extraction zone effluent are converted to hydrogen sulfide and ammonia, respectively, to form a hydrotreating zone effluent, and passing at least a portion of the hydrotreating zone effluent to a catalytic hydrodewaxing zone comprising:

(a) a first section wherein hydrogen is contacted with the hydrotreating zone effluent at catalytic dewaxing conditions at a dewaxing temperature greater than 500° F. in the presence of a first catalyst composition substantially free of Group VIII metals and comprising a shape-selective molecular sieve selected from the group consisting of gallosilicates, silicalites, zincosilicates, crystalline borosilicates, crystalline aluminosilicates, mordenites or beta aluminosilicates to form a catalytically dewaxed product, and (b) a second section wherein hydrogen is contacted with at least a portion of the catalytically dewaxed product at hydrogenation conditions at a hydrogenation temperature less than 500° F. and at least 10° F. less than the dewaxing temperature in the presence of a second catalyst composition comprising at least one Group VIII metal hydrogenation component and an amorphous refractory inorganic oxide support material.

19. The method of claim 18 wherein the hydrocarbon feedstock has a pour point of at least about 30° F. and contains at least about 3,000 ppm of sulfur-containing compounds, at least about 300 ppm of nitrogen-containing compounds and at least about 25 vol. % of aromatic compounds.

20. The method of claim 18 wherein the shape-selective molecular sieve comprises a ZSM crystalline aluminosilicate.

21. The method of claim 18 wherein the shape-selective molecular sieve comprises a crystalline gallosilicate molecular sieve.

22. The method of claim 18 wherein the shape-selective molecular sieve comprises a crystalline borosilicate molecular sieve.

23. The method of claim 22 wherein the crystalline borosilicate molecular sieve comprises HAMS-1B crystalline borosilicate molecular sieve.

24. The method of claim 18 wherein the Group VIII metal hydrogenation component comprises a noble metal selected from the group consisting of Rh, Pd, Ir and Pt.

25. The method of claim 24 wherein the noble metal is Pd.

26. The method of claim 24 wherein the noble metal is Pt.

27. A method for reducing the pour point of a hydrocarbon feedstock containing aromatic compounds, sulfur-containing compounds and nitrogen-containing compounds, said method comprising the steps of:

passing the hydrocarbon feedstock to a solvent extraction zone wherein a lube oil extraction solvent is used to extract a portion of the aromatic compounds as well as at least a portion of the sulfur-containing compounds and nitrogen-containing compounds contained in the hydrocarbon feedstock and thereby form an extraction zone raffinate, and passing at least a portion of the extraction zone raffinate to a catalytic hydrodewaxing zone comprising;

(a) a first section wherein hydrogen is contacted with extraction zone raffinate at catalytic dewaxing conditions in the presence of a first catalyst composition substantially free of Group VIII metals and comprising a shape-selective crystalline borosilicate molecular sieve to form a catalytically dewaxed product, and (b) a second section wherein hydrogen is contacted with at least a portion of the catalytically dewaxed product at hydrogenation conditions in the presence of a second catalyst composition comprising at least one Group VIII metal hydrogenation component and an amorphous refractory inorganic oxide support material.

28. A method for reducing the pour point of a hydrocarbon feedstock containing aromatic compounds, sulfur-containing compounds and nitrogen-containing compounds, said method comprising the steps of:

passing the hydrocarbon feedstock to a solvent extraction zone wherein a lube oil extraction solvent is used to extract a portion of the aromatic compounds as well as at least a portion of the sulfur-containing compounds and nitrogen-containing compounds contained in the hydrocarbon feedstock and thereby form an extraction zone raffinate, and passing at least a portion of the extraction zone raffinate to a catalytic hydrodewaxing zone comprising;

(a) a first section wherein hydrogen is contacted with extraction zone raffinate at catalytic dewaxing conditions in the presence of a first catalyst composition substantially free of Group VIII metals and comprising a shape-selective crystalline gallosilicate molecular sieve to form a catalytically dewaxed product, and (b) a second section wherein hydrogen is contacted with at least a portion of the catalytically dewaxed product at hydrogenation conditions in the presence of a second catalyst composition comprising at least one Group VIII metal hydrogenation component and an amorphous refractory inorganic oxide support material.

* * * * *